United States Patent [19]

Ljungberg

[11] 4,011,740

[45] Mar. 15, 1977

[54] ANTI-THEFT SKI LOCK ASSEMBLY

[76] Inventor: Per A. Ljungberg, 319 Onyx Ave., Balboa Island, Calif. 92662

[22] Filed: June 7, 1976

[21] Appl. No.: 693,328

[52] U.S. Cl. ..... 70/58; 70/371

[51] Int. Cl.[2] ..... E05B 73/00

[58] Field of Search ..... 70/57, 58, 371; 280/11.37 K, 11.37 A, 11.37 E, 11.37 C, 11.37 R, 11.13 T; 211/60 SK

[56] References Cited

UNITED STATES PATENTS

| | | | |
|---|---|---|---|
| 3,277,676 | 10/1966 | Poehlmann | 70/58 |
| 3,412,585 | 11/1968 | Berryman | 70/58 |
| 3,461,696 | 8/1969 | Seka | 70/58 |
| 3,720,083 | 3/1973 | Wellekens | 70/38 A |
| 3,966,219 | 6/1976 | Look | 280/611 |

FOREIGN PATENTS OR APPLICATIONS

| | | | |
|---|---|---|---|
| 1,512,617 | 1/1968 | France | 70/58 |

*Primary Examiner*—Robert L. Wolfe
*Attorney, Agent, or Firm*—William C. Babcock

[57] ABSTRACT

An anti-theft ski lock assembly that secures a pair of skis together to define a cross configuration. The skis, when in the cross configuration, are so difficult and uncomfortable to carry, that it will readily be apparent that the person carrying the skis is not the owner thereof, and that the skis are being carried by a person not authorized so to do.

5 Claims, 5 Drawing Figures

FIG. 1
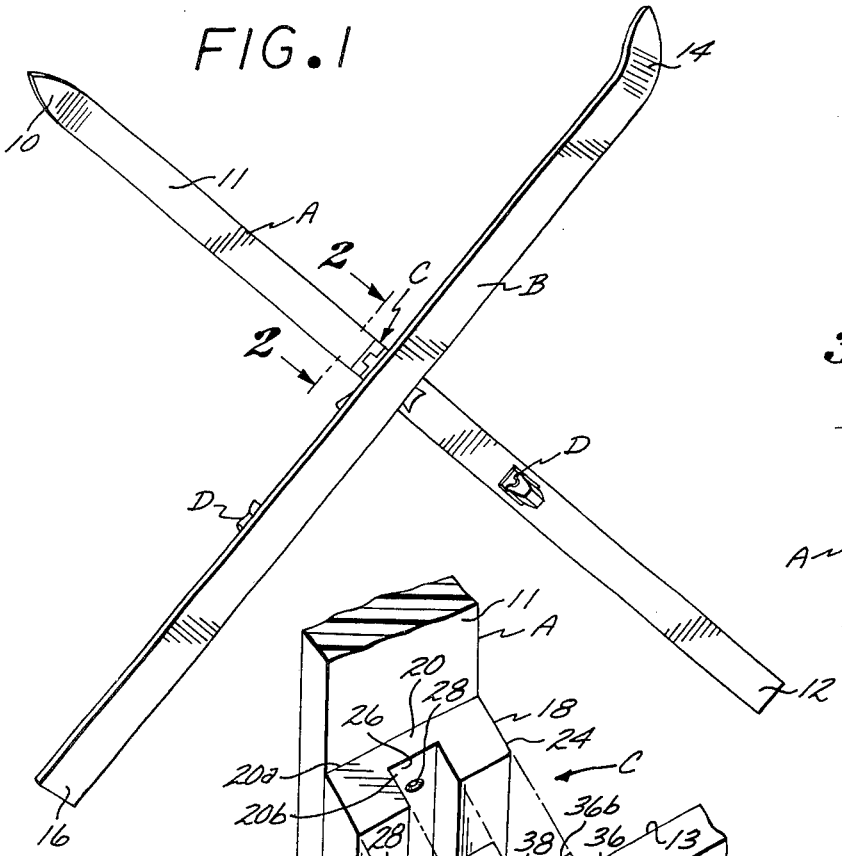
FIG. 2
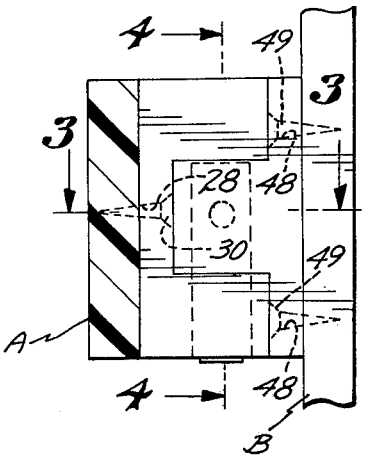
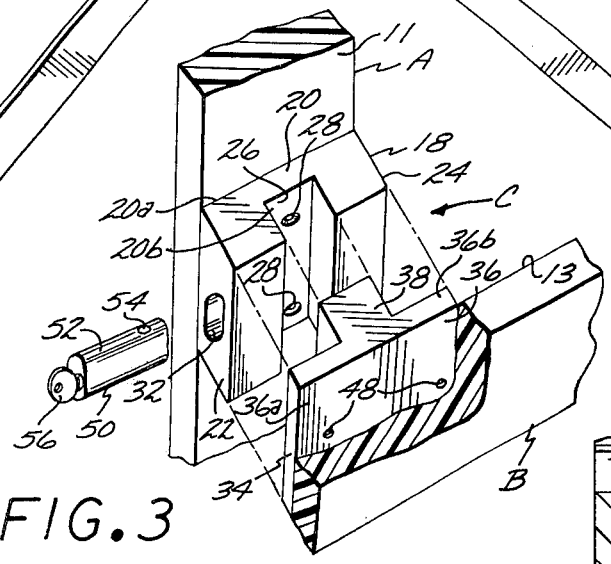
FIG. 3
FIG. 4
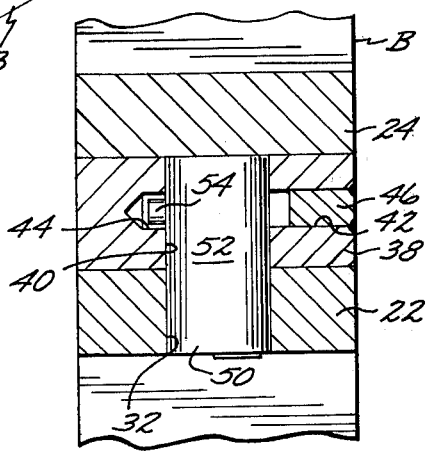
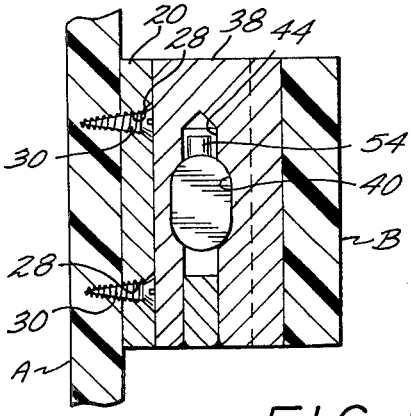
FIG. 5

ANTI-THEFT SKI LOCK ASSEMBLY

BACKGROUND OF THE INVENTION

1. Field of the Invention

Anti-theft ski lock assembly.

2. Description of the Prior Art

In the past, numerous devices have been devised and used to lock a pair of skis together at a fixed location in a designated area at a ski resort. Although such devices serve their intended purpose in the designated area, skis are frequently stolen from locations apart from such an area.

The primary purpose in devising the present invention is to supply an anti-theft ski lock assembly that permits the owner of a pair of skis to lock the same in a cross configuration either when the skis are in the designated area previously mentioned or apart therefrom, and the skis when in this configuration being so difficult and uncomfortable to carry that it will readily be apparent to onlookers that the person carrying the skis is not the owner thereof, and that the skis are being taken without the owner's permission.

Another object of the invention is to supply an anti-theft ski lock assembly that has a simple mechanical structure, is simple and easy to use, and with certain components of the assembly being permanently mounted on the skis in such a manner that they will in no way interfere with the normal usage of the skis.

A still further object of the invention is to supply an anti-theft ski lock assembly that may be used either in the designated area previously mentioned, or in any area where the owner of the skis finds it desirable to protect the skis from theft.

SUMMARY OF THE INVENTION

The present invention is used in combination with a pair of skis that each have a longitudinally extending top surface to which a conventional binding is secured at a position intermediate the ends of the skis. The lock assembly may be used to secure the pair of skis together to define a cross configuration that renders the skis unweildy and uncomfortable to carry for any sustained distance, and due to this configuration will immediately indicate to onlookers that the skis are being carried by a person other than the owner thereof.

The anti-theft ski lock assembly includes a first lock member that is defined by a first plate that has first and second oppositely disposed side surfaces, first and second spaced ribs that extend outwardly from the second side surface and with the first rib having a transverse opening therein. The first and second ribs cooperate with the plate to define an elongate face therebetween.

A second lock member is provided that includes a second plate that has first and second oppositely disposed side surfaces, and a third rib that extends outwardly from the second side surface. The third rib is of such width and depth as to be removably insertable in the elongate face. The third rib has a transverse opening therein that may be aligned with the opening in the first rib, and the third rib also having a recess defined therein that is normal to the transverse opening therein and in communication with this opening.

First means are provided, preferably in the form of screws, for securing the first lock member to the first ski, with the first side surface of the first lock member being in abutting contact with the top surface of the first ski, and the first and second ribs and elongate face of the first lock member being longitudinally positioned relative to the first ski.

Second means are provided, also preferably in the form of screws, for securing the second lock member to the second ski, with the first side surface of the second lock member being in abutting contact with the top surface of the second ski, and the third rib transversely disposed relative to the longitudinal axis of the second ski.

A lock assembly is provided that includes an elongate lock body that slidably and snugly engages the openings in the first and third ribs when these openings are transversely aligned. A lock pin is included as a part of the lock assembly, which lock pin is transversely movable relative to the lock body and alignable with the recess previously mentioned. The lock assembly may be actuated by either a key or combination lock, to move the pin to either a projecting or retracted position. When the pin is in the projecting position and engageable with the recess, the lock assembly holds the first and second lock members in interlocking engagement and the first and second skis in the cross configuration. When the pin is moved to the retracted position, the lock body may be removed from the openings, and the first and second lock members separated from one another to permit the skis to be used in their normal manner.

BRIEF DESCRIPTION OF THE DRAWING

FIG. 1 is a perspective view of a pair of skis locked together to define a cross configuration by use of the invention;

FIG. 2 is a transverse cross-sectional view of one of the skis and an end elevational view of the invention;

FIG. 3 is a perspective view of the invention with the components thereof separated from one another;

FIG. 4 is a longitudinal cross-sectional view of the invention taken on the line 4—4 of FIG. 2; and FIG. 5 is a longitudinal cross-sectional view of the invention.

DESCRIPTION OF THE PREFERRED EMBODIMENT

In FIGS. 1 and 3 it will be seen that the lock assembly C is used in conjunction with a conventional first ski A that has a first end 10 and second end 12. A second ski B, identical to the first ski A, is provided that has a first end 14 and second end 16. The first and second skis A and B have longitudinally extending upper surfaces 11 and 13 to which conventional bindings D are secured as may be seen in FIG. 1.

The lock assembly C includes a first lock member 18 that is defined by a first plate 20 that has a first side surface **20*a* and a second side surface 20*b*. First and second laterally spaced ribs 22 and 24 project from the second side surface 20*b* and cooperate with that side surface to define a longitudinally extending space 26. The plate 20 between the first and second ribs 22 and 24 has a number of spaced bores 28 formed therein, through which screws 30 may extend to secure the first lock member 18 to the first ski A as shown in FIG. 5. A transverse first oval-shaped opening 32 is formed in the first rib 22 as shown in FIG. 3.**

The lock assembly C includes a second lock member 34 best seen in FIG. 3, which second lock member includes a second plate 36 that has a first side surface **36*a* and second side surface 36*b*. A third rib 38 extends from the second side surface 36*b*** and is of such width and depth as to be removably insertable in the space 26. The third rib 38 has a second transverse oval-shaped opening 40 therein that may be aligned with the first oval-shaped opening 32 when the third rib is inserted in the longitudinal space 26. The third rib has a bore 42 formed therein through which a drill (not shown) is extended to form a recess 44 in the third rib, which recess is in communication with the second transverse opening 40. The bore 42, after recess 44 is formed, is closed by means of a plug 46 as shown in FIG. 4. The second plate 36 has a number of spaced bores 48 formed therein through which screws 49 extend to secure the second lock member 34 to the second ski B.

A lock 50 is provided, such as is used on file cabinets, which lock includes a body 52 of such transverse cross section that it may snugly and slidably engage the first and second openings 32 and 40 when they are aligned. The lock body 52 movably supports a pin 54 that may be moved transversely to either a retracted or projecting position relative to the body by use of a key or other means such as a combination dial or the like (not shown).

When it is desired to lock the first and second skis A and B into the cross configuration shown in FIG. 1, the third rib 38 is inserted into the space 26, and the openings 32 and 40 placed in transverse alignment. The lock 50 is then extended through the aligned openings 32 and 40 with the pin in the retracted position, and after the lock is disposed in these openings, the key 56 is used to move the pin 54 to a projecting position where it engages the recess 44. The first and second skis A and B are now locked together in the cross configuration shown in FIG. 1 where they are unweildy and uncomfortable to carry, and immediately indicate to onlookers that the person carrying the skis is unauthorized so to do, and is not the owner thereof. When it is desired to use the skis A and B, the key 56 is used to move the pin 54 to the respective position, to permit the lock 50 to be removed from the first and second openings 32 and 40. The third ribs 38 may now be removed from the space 26, and the skis A and B may now be used for their intended purpose and in their normal manner, and without the lock assembly in any way interfering with such use. It will be particularly noted in FIGS. 2 and 5 that the screws 30 and 49 are concealed when the lock assembly C is in the locking position, and when so disposed the screws cannot be removed by an unauthorized person to permit the pair of skis A and B to be carried in a normal manner.

The use and operation of the invention has been explained previously in detail and need not be repeated.

I claim:

1. In combination with a pair of skis that each have a longitudinally extending top surface to which a binding is secured at a position intermediate the ends thereof, a lock assembly for securing said pair of skis together to define a cross configuration that prevents said pair of skis being carried comfortably from a location at which they were locked together, said lock assembly including:

a. a first lock member that includes a first plate that has first and second oppositely disposed side surfaces, first and second spaced ribs that extend outwardly from said second side surface, with said first rib having a transverse opening therein, and said first and second ribs defining an elongate space therebetween;

b. a second lock member that includes a second plate that has first and second oppositely disposed side surfaces, a third rib that extends outwardly from said second side surface, with said third rib of such width and depth as to be removably insertable in said elongate space, said third rib having a transverse opening therein that may be aligned with said opening in said first rib, and a recess in said third rib that is normal to said transverse opening and in communication therewith;

c. first means for securing said first lock member to said first ski, with said first side surface of said first lock member in abutting contact with said top surface of said first ski and said first and second ribs and elongate space extending longitudinally relative to said first ski;

d. second means for securing said second lock member to said second ski, with said first side surface of said second lock member in abutting contact with said top surface of said second ski and said third rib transversely disposed relative to said second ski; and e. a lock assembly that includes an elongate lock body that slidably and snugly engages said openings in said first and third ribs when said openings are aligned, a lock pin transversely movable relative to said body and alignable with said recess, and third means for moving said pin between a projecting and retracted position, said pin when in said projecting position and in engagement with said recess holding said first and second lock members in interlocking engagement and said first and second skis in said cross configuration, and said pin when in said retracted position permitting said lock assembly to be withdrawn from said openings in said first and third ribs and said first and second skis separated.

2. A lock assembly as defined in claim 1 in which said first and second lock members are secured to said first and second skis intermediate ends of said bindings and the ends of said skis most adjacent said ends of said bindings.

3. A lock assembly as defined in claim 1 in which said first means are a plurality of first screws that extend through a plurality of spaced bores in a portion of said first plate situated between said first and second ribs to engage said first ski, with said first screws being concealed when said third rib is in said elongated space.

4. A lock assembly as defined in claim 1 in which said second means are a plurality of second screws that extend through a plurality of spaced bores in said second plate to engage said second ski, with said second screws being concealed when said third rib is in said elongate space.

5. A lock assembly as defined in claim 1 in which said third means is a key that removably engages said lock body.

* * * * *